United States Patent [19]

Anzai et al.

[11] 4,182,292

[45] Jan. 8, 1980

[54] CLOSED LOOP MIXTURE CONTROL SYSTEM WITH A VOLTAGE OFFSET CIRCUIT FOR BIPOLAR EXHAUST GAS SENSOR

[75] Inventors: Makoto Anzai, Yokosuka; Akio Hosaka, Yokohama, both of Japan

[73] Assignee: Nissan Motor Co., Limited, Yokohama, Japan

[21] Appl. No.: 909,945

[22] Filed: May 26, 1978

[30] Foreign Application Priority Data

May 27, 1977 [JP] Japan ..... 52-67612[U]

[51] Int. Cl.[2] ..... F02B 3/08

[52] U.S. Cl. ..... 123/119 EC; 123/32 EE

[58] Field of Search ..... 123/119 EC, 32 EA, 32 EE; 60/276, 285

[56] References Cited

U.S. PATENT DOCUMENTS

| | | | |
|---|---|---|---|
| 3,745,768 | 7/1973 | Zechnall et al. | 123/32 EE |
| 4,031,866 | 6/1977 | Asano | 123/32 EE |
| 4,040,408 | 8/1977 | Kraus et al. | 123/32 EE |
| 4,112,893 | 9/1978 | Anzai | 123/119 EC |
| 4,120,270 | 10/1978 | Asano et al. | 123/119 EC |
| 4,131,089 | 12/1978 | Fugishiro et al. | 60/276 |
| 4,142,482 | 3/1979 | Asano et al. | 123/119 EC |

*Primary Examiner*—Charles J. Myhre
*Assistant Examiner*—R. A. Nelli
*Attorney, Agent, or Firm*—Schwartz, Jeffery, Schwaab, Mack, Blumenthal & Koch

[57] ABSTRACT

A closed loop mixture control system for an internal combustion engine of a motor vehicle is provided with a voltage divider connected across the terminals of a single source of DC potential mounted on the vehicle to develop an offset voltage which is combined with the output of an exhaust gas sensor having a bipolar output characteristic. One of the polarities of the exhaust gas sensor output is compensated for by the offset voltage.

3 Claims, 1 Drawing Figure

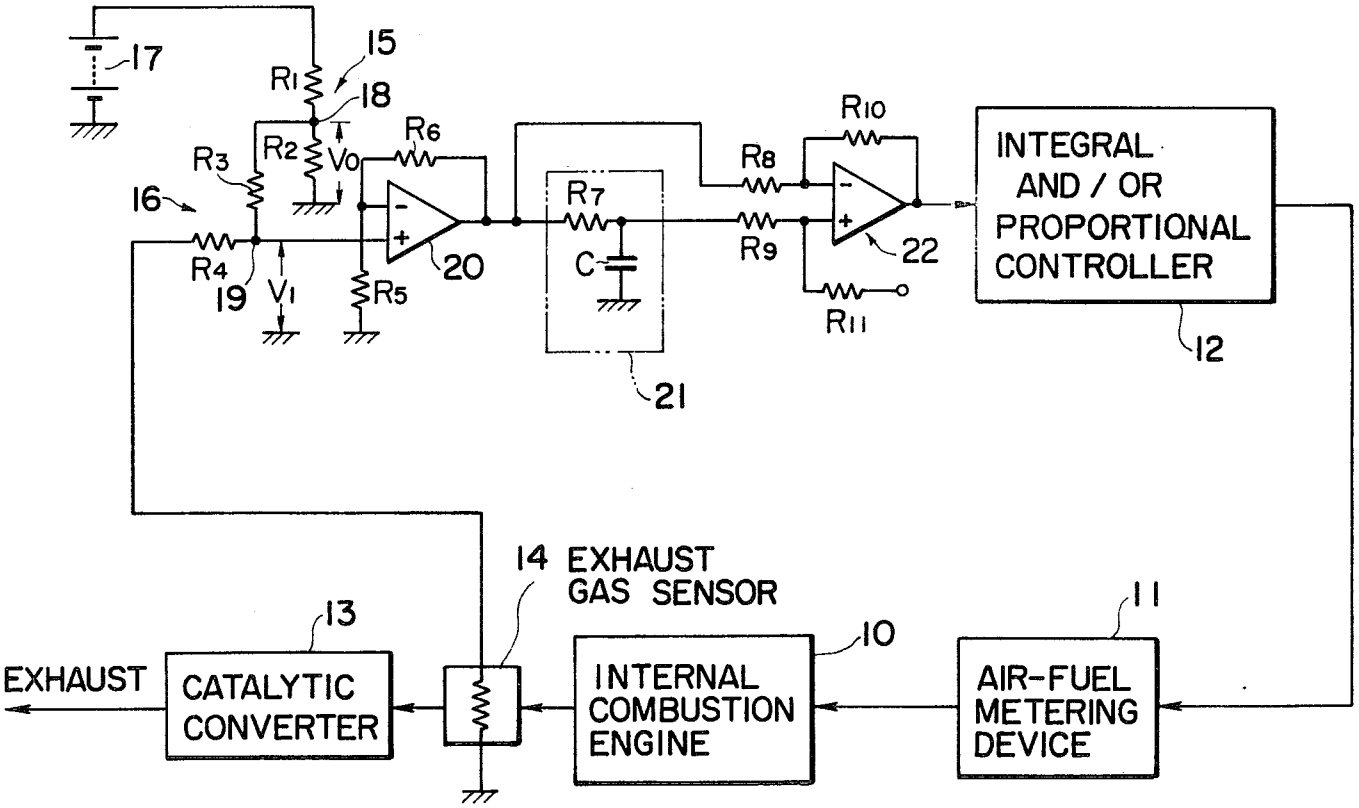
INTEGRAL AND / OR PROPORTIONAL CONTROLLER
12
AIR-FUEL METERING DEVICE
11
INTERNAL COMBUSTION ENGINE
10
EXHAUST GAS SENSOR
14
CATALYTIC CONVERTER
13
EXHAUST
R10
22
R11
R8
R9
21
R7
C
20
R6
R5
15
18
R1
R2
Vo
Vi
R3
R4
19
16
17

CLOSED LOOP MIXTURE CONTROL SYSTEM WITH A VOLTAGE OFFSET CIRCUIT FOR BIPOLAR EXHAUST GAS SENSOR

BACKGROUND OF THE INVENTION

The present invention relates to a closed-loop mixture control system for a vehicle's internal combustion engine.

Closed-loop mixture control operation is based upon a feedback signal derived from an exhaust gas sensor which senses the concentration of a predetermined constituent gas of the exhaust emissions so as to represent air-fuel ratio within the exhaust system of the engine. This sensor is designed to produce a unipolar signal which has a rapid transition in amplitude at stoichiometry between zero voltage level to a certain positive potential. However, there is a certain type of exhaust gas sensors which exhibit bipolar output characteristics. Since the signal of the gas sensor output must be processed in later stages to develop a suitable control signal, the bipolar characteristic of the sensor signal would necessitate the use of two storage batteries, one of which is grounded at its negative potential terminal and the other of which is grounded at its positive potential terminal, if such exhaust gas sensors are employed in a motor vehicle. Since the automotive vehicle is usually equipped with a single source of DC voltage, the employment of the additional DC source is disadvantageous.

SUMMARY OF THE INVENTION

The primary object of the invention is to eliminate the aforesaid disadvantage of deriving an offset voltage from a single DC source and combining the offset voltage with the exhaust gas sensor output to cancel one of the opposite polarity voltages. Specifically, there is provided a first voltage divider connected across the terminals of a vehicle storage battery to develop a voltage of positive polarity. A second voltage divider is provided to scale down both the positive polarity voltage of the first voltage divider and the output voltage of the exhaust gas sensor and to provide summation of the scaled-down voltages. By the summation of the two voltage signals, the negative polarity swing of the exhaust gas sensor is offset so that it provides only a positive voltage signal. This permits only a single source of DC potential to process the exhaust gas sensor output in later stages to derive a suitable feedback control signal.

BRIEF DESCRIPTION OF THE DRAWING

The invention will be further described with reference to the sole drawing in which the closed-loop mixture control system embodying the invention is illustrated.

DETAILED DESCRIPTION

In the sole drawing, the internal combustion engine 10 is supplied with a mixture of air and fuel at variable ratio from the air-fuel metering device 11 such as electronic fuel injection nozzle in response to a signal supplied from an integral and/or proportional controller 12. The spent gases from the engine 10 are exhausted through a catalytic converter 13 to the atmosphere. In the exhaust manifold of the engine is provided an exhaust gas sensor 14 such as oxygen sensor which generates a signal representative of the concentration of oxygen in the exhaust emissions. This sensor has a characteristic transition of output levels between, for example, a negative voltage of 0.5 volts and a positive voltage of 0.5 volts in response to the air-fuel ratio corresponding to stoichiometry. Specifically, when the air-fuel ratio within the exhaust manifold, as represented by the sensed oxygen concentration, is below the stoichiometric value (rich), the output signal remains at the positive side and it goes to the negative side when the mixture becomes leaner than stoichiometry.

In order to compensate for the negative voltage output of the exhaust gas sensor 14, there is provided a resistor network comprising a first voltage divider 15 and a second voltage divider 16. The first voltage divider 15 is formed by series-connected resistors R1 and R2 which are connected between ground and a positive terminal of the vehicle's storage battery 17 of which the negative terminal is grounded, so that voltage $V_0$ is developed at the junction 18 with respect to ground. The voltage divider 16 is formed by series connected resistors R3 and R4 which are in turn connected between the junction 18 and an output lead of the exhaust gas sensor 14. The voltage divider 16 is to scale down both voltage $V_0$ and the exhaust gas sensor voltage by the ratio of resistances R3 and R4 and provide summation of the scaled-down voltages at a junction 19 to develop a voltage $V_1$ thereat with respect to ground. Each of the resistances R3 and R4 is 10 to 100 times greater than the resistance R2. The voltage $V_0$ and the relative values of the resistors R3 and R4 are so selected that voltage $V_1$ varies in a range from zero to a certain positive value for the full range of exhaust gas sensor voltages. For instance, if $R3=R4$ and $V_0=0.5$ volts, voltage $V_1$ takes on a value which varies in a range from zero to $+0.5$ volts for the exhaust gas sensor output ranging from $-0.5$ volts to $+0.5$ volts.

The exhaust gas sensor output thus varies in a positive range, and is applied to the noninverting input terminal of an operational amplifier 20 whose inverting input terminal is connected to a junction between resistors R5 and R6 coupled in a series circuit between ground and the output terminal of the operational amplifier 20. The amplifier 20 arranged in this circuit configuration operates as a DC buffer amplifier so that the output of the amplifier 20 is an amplified positive excursion of the exhaust gas sensor output.

The output of the amplifier 20 is applied on the one hand through an averaging circuit 21 formed by series-connected resistor R7 and capacitor C and via resistor R9 to the noninverting input terminal of a differential amplifier 22 and on the other hand via a resistor R8 to the inverting input thereof. The averaging circuit 21 provides integration of the input signal with respect to time and develops a voltage across the capacitor C to represent a mean value of the positive excursion of the exhaust gas sensor 14. The resistance R7 and capacitance C are so selected that the mean value of the positive excursion corresponds to one half of the maximum positive peak value of the output of amplifier 20. This time-integral mean vaue is used as a reference level to represent the desired air-fuel ratio with which the voltage at the inverting input of differential amplifier 22 is compared to derive a signal representing the deviation of the air-fuel ratio within the exhaust manifold from the desired air-fuel ratio. The deviation representative signal is then supplied to the controller 12 where the amplitude of the input signal is modified in such manner as to minimize the average error of the closed-loop controlled air-fuel ratio and/or minimize the time delay error of the controlled air-fuel ratio.

In cases where the storage battery 17 is grounded at its positive terminal, the output leads of the exhaust gas sensor 14 should be reversed to each other to provide a negative voltage excursion at the output of amplifier 20.

What is claimed is:

1. A closed-loop mixture control system for an internal combustion engine in a motor vehicle including an exhaust gas sensor disposed in the exhaust system of the engine for sensing the concentration of an exhaust composition, air-fuel supplying means for supplying air and fuel to said engine, said exhaust gas sensor being of the type which generates a signal varying between a first polarity voltage level and a second polarity voltage level depending upon whether the sensed concentration is above or below a predetermined value, and means for deriving a control signal representative of the deviation of air-fuel ratio within said exhaust system, as represented by the sensed concentration, from a desired air-fuel ratio for adjusting said air-fuel supplying means, said vehicle including a storage battery having first and second polarity voltage terminals wherein the first polarity voltage terminal is connected to be used as a reference potential, wherein the improvement comprises:

a voltage divider connected between the first and second polarity terminals of said storage battery to develop a voltage of the second polarity; and means for providing summation of the output of said voltage divider and the output of said exhaust gas sensor to offset the first polarity voltage of the exhaust gas sensor output, the output of the summation means being connected to said means for deriving the deviation representative signal.

2. A closed-loop mixture control system as claimed in claim 1, wherein said voltage divider comprises a first and a second resistor connected in a series circuit between said terminals of the storage battery, and said summation means comprises a third and a fourth resistor connected in a series circuit between said exhaust gas sensor and the junction of said first and second resistors, the voltage at the junction of said third and fourth resistors being applied to said means for deriving the deviation representative signal.

3. A closed-loop mixture control system as claimed in claim 1, wherein said means for deriving the deviation representative signal comprises an averaging circuit for generating a signal representative of a mean value of the varying amplitudes of the output from said summation means and a differential amplifier having first and second input terminals a first input terminal connected to be responsive to the output from said summation means and a second input terminal connected to be responsive to the output from said averaging circuit.

* * * * *